US009612582B1

(12) United States Patent
Wang et al.

(10) Patent No.: US 9,612,582 B1
(45) Date of Patent: Apr. 4, 2017

(54) WEARABLE DEVICE

(71) Applicant: Quanta Computer Inc., Taoyuan (TW)

(72) Inventors: Chun-Yuan Wang, Taoyuan (TW); Chi-Hsuan Lee, Taoyuan (TW); Yu-Chun Lu, Taoyuan (TW); Chung-Ting Hung, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 15/059,246

(22) Filed: Mar. 2, 2016

(30) Foreign Application Priority Data

Jan. 25, 2016 (TW) ..... 105102164 A

(51) Int. Cl.

| | |
|---|---|
| ***G04R 60/02*** | (2013.01) |
| ***H01Q 1/27*** | (2006.01) |
| ***G04G 17/04*** | (2006.01) |
| ***G04G 21/04*** | (2013.01) |
| ***G04R 60/06*** | (2013.01) |

(52) U.S. Cl.
CPC ..... *G04G 17/04* (2013.01); *G04G 21/04* (2013.01); *G04R 60/02* (2013.01); *G04R 60/06* (2013.01); *H01Q 1/273* (2013.01)

(58) Field of Classification Search
CPC ..... G04R 60/02; G04R 60/04; G04R 60/06; H01Q 1/273; G04G 17/04; G04G 21/04
See application file for complete search history.

(56) References Cited

U.S. PATENT DOCUMENTS 5,946,610 A * 8/1999 Hama ..... H01Q 1/22 343/702
6,373,439 B1 * 4/2002 Zurcher ..... G04B 47/00 343/702
7,215,600 B1 * 5/2007 DeRosa ..... G04G 21/04 343/718
7,417,596 B2 * 8/2008 Zellweger ..... H01Q 1/273 343/702
8,570,838 B2 * 10/2013 Fujisawa ..... G04C 10/02 343/718
9,130,272 B2 * 9/2015 Fujisawa ..... G04G 5/002 343/718
2005/0054321 A1 * 3/2005 Casagrande ..... G04G 21/04 455/351
2005/0219955 A1 * 10/2005 Xu ..... G04G 21/04 368/88
2009/0316536 A1 * 12/2009 Kachi ..... G04G 17/08 368/278
2014/0225786 A1 8/2014 Lyons et al.

FOREIGN PATENT DOCUMENTS

CN 103943945 7/2014

OTHER PUBLICATIONS

Chinese language office action dated Jan. 9, 2017, issued in application No. TW 105102164.

* cited by examiner

*Primary Examiner* — Vit W Miska

(74) *Attorney, Agent, or Firm* — McClure, Qualey & Rodack, LLP

(57) ABSTRACT

A wearable device includes a crown element, a body element, and a bottom element. A hollow structure is formed by the crown element, the body element, and the bottom element. A first antenna structure and a second antenna structure are formed by the crown element and the body element. The first antenna structure and the second antenna structure cover the same operation frequency band.

8 Claims, 8 Drawing Sheets

WEARABLE DEVICE

CROSS REFERENCE TO RELATED APPLICATIONS

This Application claims priority of Taiwan Patent Application No. 105102164 filed on Jan. 25, 2016, the entirety of which is incorporated by reference herein.

BACKGROUND OF THE INVENTION

Field of the Invention

The disclosure generally relates to a wearable device, and more specifically, to a wearable device including an antenna structure.

Description of the Related Art

With the progress being made in mobile communication technology, mobile devices such as portable computers, mobile phones, tablet computers, multimedia players, and other hybrid functional mobile devices have become common. To satisfy the user demand, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

According to some research reports, researchers predict that the next generation of mobile devices will be "wearable devices". For example, wireless communication may be applied to watches, glasses, and even clothes in the future. However, watches, for example, do not have a large enough space to accommodate antennas for wireless communication. Accordingly, this has become a critical challenge for antenna designers.

BRIEF SUMMARY OF THE INVENTION

In a preferred embodiment, the invention is directed to a wearable device including a crown element, a body element, and a bottom element. A hollow structure is formed by the crown element, the body element, and the bottom element. A first antenna structure and a second antenna structure are formed by the crown element and the body element.

In some embodiments, the wearable device is a watch. The crown element is a watch crown element. The body element is a watch body element. The bottom element is a watch bottom element.

In some embodiments, the crown element, the body element, and the bottom element are made of metal materials.

In some embodiments, the wearable device further includes a transparent element. The transparent element is surrounded by the crown element.

In some embodiments, a first separation gap is formed between the crown element and the body element, and a second separation gap is formed between the body element and the bottom element. Both the first separation gap and the second separation gap are filled with nonconductive materials.

In some embodiments, the crown element includes a left-half loop portion and a right-half loop portion. The body element includes a front wall portion, a right-side wall portion, a back wall portion, and a left-side wall portion.

In some embodiments, the right-half loop portion is coupled to the right-side wall portion so as to form the first antenna structure. The left-half loop portion is coupled to the left-side wall portion so as to form the second antenna structure.

In some embodiments, the front wall portion or the back wall portion is configured as an extension portion of the first antenna structure or an extension portion of the second antenna structure.

In some embodiments, the first antenna structure and the second antenna structure cover the same operation frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1A:
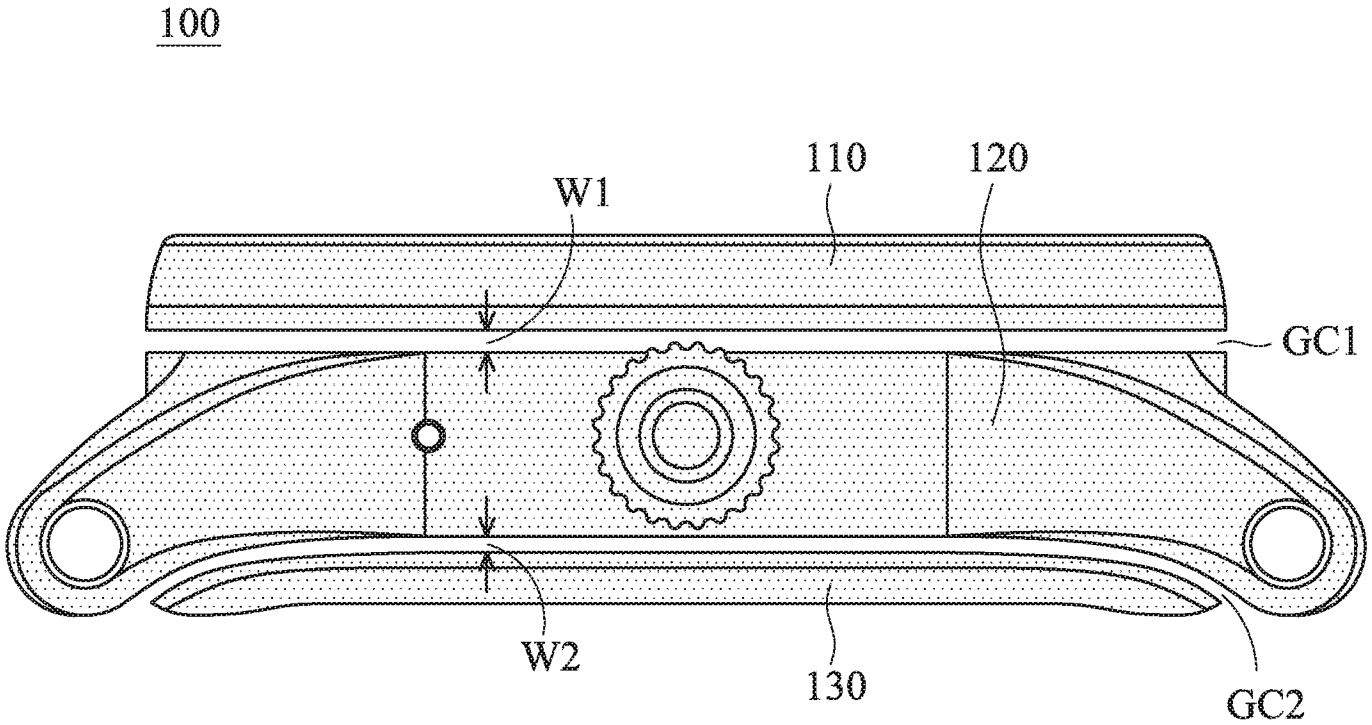
FIG. 1A is a side view of a wearable device according to an embodiment of the invention.
Figure 1B:
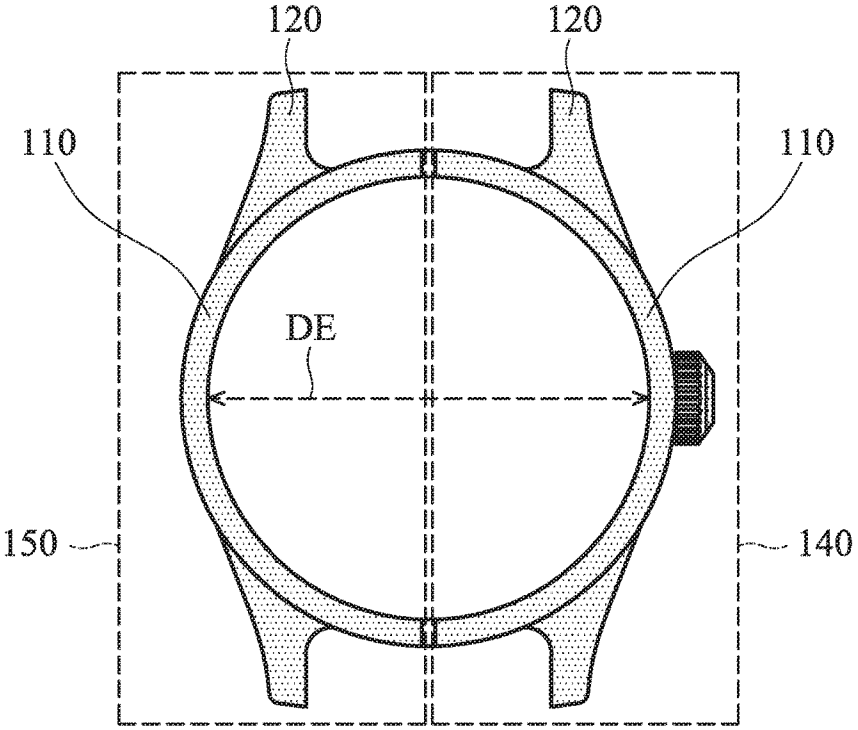
FIG. 1B is a top view of a wearable device according to an embodiment of the invention.

FIG. 1A is a side view of a wearable device 100 according to an embodiment of the invention. FIG. 1B is a top view of the wearable device 100 according to an embodiment of the invention. Please refer to FIG. 1A and FIG. 1B together. In a preferred embodiment, the wearable device 100 is a wrist-wearable device, such as a smart watch or a smart, sporty bracelet.

As shown in FIG. 1A and FIG. 1B, the wearable device 100 at least includes a crown element 110, a body element 120, and a bottom element 130. A hollow structure is formed by the crown element 110, the body element 120, and the bottom element 130. For example, the hollow structure may be a hollow cylinder or a hollow rectangular prism. The crown element 110, the body element 120, and the bottom element 130 may be made of metal materials, such as copper, silver, aluminum, iron, or their alloys. The shape, pattern, and surface treatment of the crown element 110, the body element 120, and the bottom element 130 are not limited in the invention. A first separation gap GC1 may be formed between the crown element 110 and the body element 120. A second separation gap GC2 may be formed between the body element 120 and the bottom element 130. The first separation gap GC1 partially or completely separates the crown element 110 from the body element 120. The second separation gap GC2 partially or completely separates the body element 120 from the bottom element 130. Both the first separation gap GC1 and the second separation gap GC2 may be filled with nonconductive materials, such as plastic materials. The width W1 of the first separation gap GC1 may be larger than 0 mm, and preferably 1 mm. The width W2 of the second separation gap GC2 may be larger than 0 mm, and preferably 1 mm.

A first antenna structure 140 and a second antenna structure 150 of the wearable device 100 are formed by the crown element 110 and the body element 120. For example, the first antenna structure 140 may be formed by the right-half portion of the crown element 110 and the right-half portion of the body element 120, and the second antenna structure 150 may be formed by the left-half portion of the crown element 110 and the left-half portion of the body element 120. The first antenna structure 140 and the second antenna structure 150 can cover the same operation frequency band. The first antenna structure 140 is configured as a main antenna of the wearable device 100, and the second antenna structure 150 is configured as an auxiliary antenna of the wearable device 100, so as to increase the antenna diversity gain of the wearable device 100. In some embodiments, the wearable device 100 further includes a PCB (Printed Circuit Board), which is disposed in the aforementioned hollow structure. A first signal source and a second signal source may be positioned on the PCB, and they are arranged for exciting the first antenna structure 140 and the second antenna structure 150, respectively.

In some embodiments, the aforementioned hollow structure, formed by the crown element 110, the body element 120, and the bottom element 130, is a box without a top lid, such as a hollow cylinder without a top lid. The hollow cylinder may have a circular opening on the top, and the diameter DE of the circular opening may be from 1 to 2 inches, and preferably be 1.39 inches. In alternative embodiments, the aforementioned circular opening is replaced with a square opening or a triangular opening. Specifically, the crown element 110 surrounds the opening of the box without the top lid, the body element 120 forms a side wall of the box without the top lid, and the bottom element 130 forms a bottom plate of the box without the top lid. The aforementioned hollow structure can accommodate a variety of device components, such as a battery, an hour hand, a minute hand, a second hand, an RF (Radio Frequency) module, a signal processing module, a counter, a processor, a thermometer, and/or a barometer (not shown). It should be understood that the wearable device 100 may further include other components, such as a time adjuster, a connection belt, a waterproof housing, and/or a buckle, although these components are not displayed in FIG. 1A and FIG. 1B.

Figure 1C:
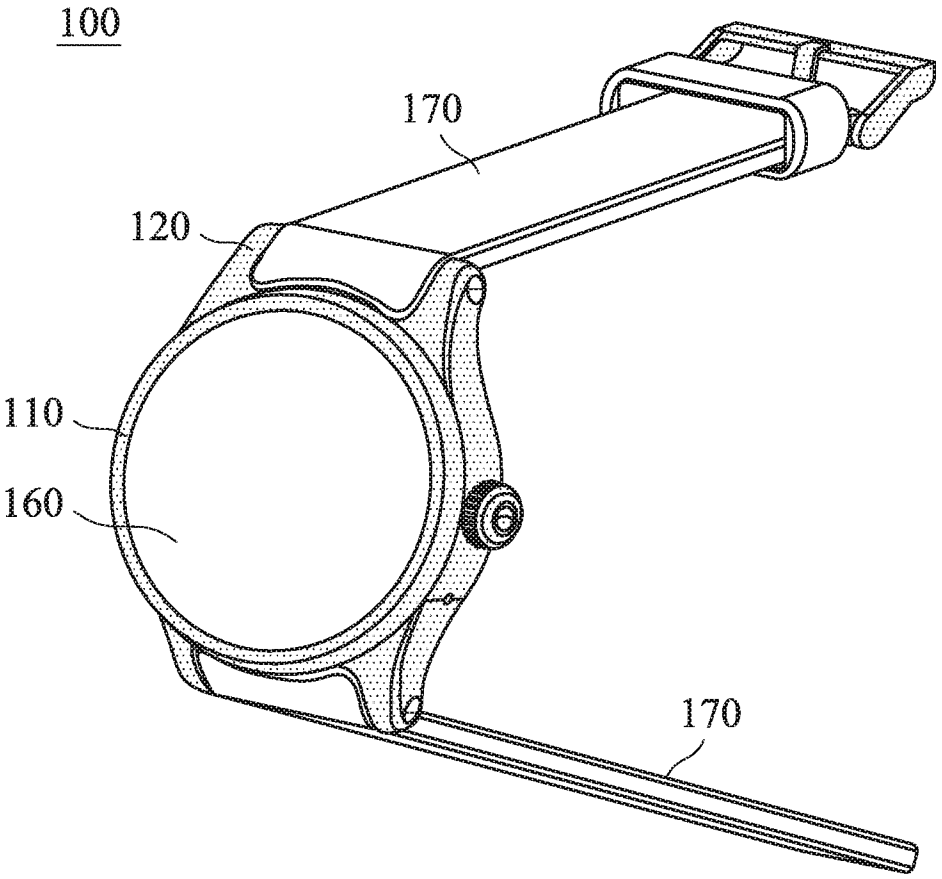
FIG. 1C is a perspective view of a wearable device according to an embodiment of the invention.

FIG. 1C is a perspective view of the wearable device 100 according to an embodiment of the invention. In the embodiment of FIG. 1C, the wearable device 100 is implemented with a watch. The crown element 110 is a watch crown element. The body element 120 is a watch body element. The bottom element 130 is a watch bottom element. With such a design, the wearable device 100 further includes a transparent element 160 and a watchband 170. For example, the transparent element 160 may be a watch surface glass or a transparent plastic board. The transparent element 160 may be disposed inside the crown element 110, and surrounded by the crown element 110. Other watch components, such as an hour hand, a minute hand, and a second hand, may all be disposed under the transparent element 160 for the user to observe them. The watchband 170 may be connected to two opposite sides of the body element 120, so that the user can wear the wearable device 100 on the wrist using the watchband 170.

Figure 2B:
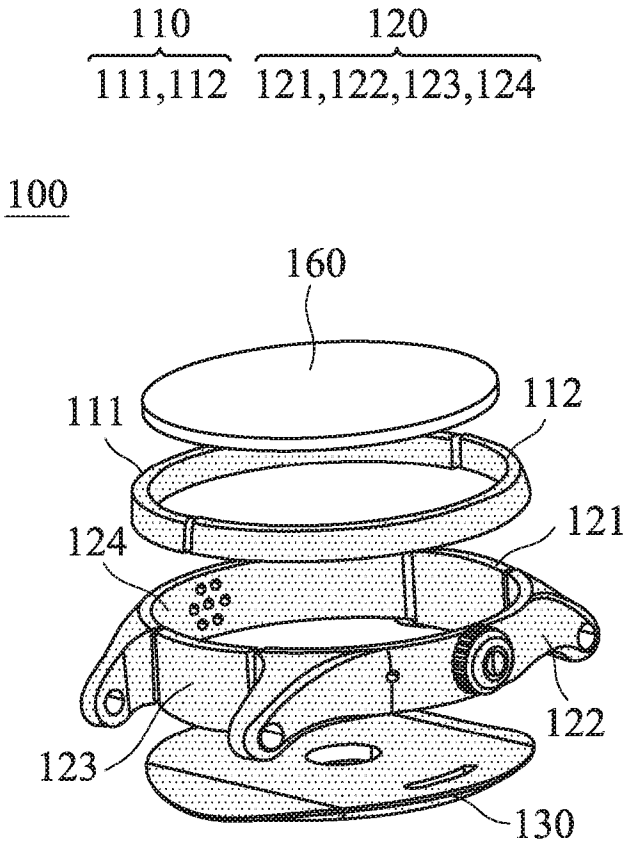
FIG. 2B is a combined view of a wearable device according to an embodiment of the invention.
Figure 2A:
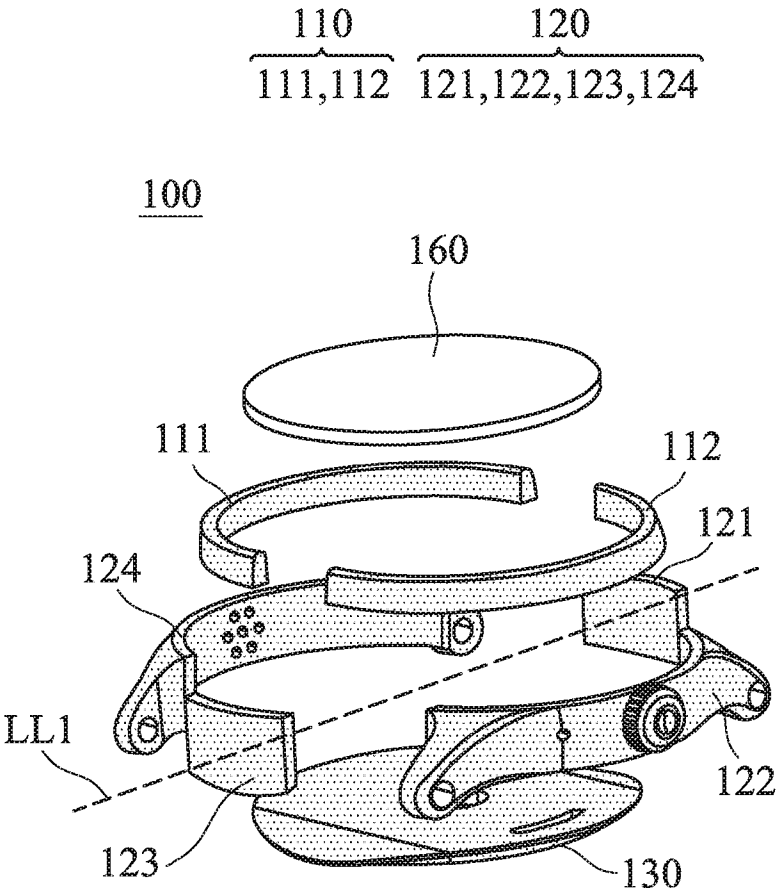
FIG. 2A is an exploded view of a wearable device according to an embodiment of the invention.

FIG. 2A is an exploded view of the wearable device 100 according to an embodiment of the invention. FIG. 2B is a combined view of the wearable device 100 according to an embodiment of the invention. Please refer to FIG. 1A and FIG. 1B together. In the embodiment of FIG. 2A and FIG. 2B, the crown element 110 includes a left-half loop portion 111 and a right-half loop portion 112, and the body element 120 includes a front wall portion 121, a right-side wall portion 122, a back wall portion 123, and a left-side wall portion 124. The above terms "front", "back", "left", and "right" are exemplary for the reader to understand the relative positions of elements, and they are not restrictions of the element arrangement of the invention. Both the crown element 110 and the body element 120 substantially have line-symmetry structures. Specifically, the left-half loop portion 111 and the right-half loop portion 112 of the crown element 110 are symmetrical with respect to a central line LL1, and the left-side wall portion 124 and the right-side wall portion 122 of the body element 120 are also symmetrical with respect to the central line LL1. Each of the left-half loop portion 111 and the right-half loop portion 112 of the crown element 110 may have an arc-shape which is substantially equal to 180 degrees. Each of the left-side wall portion 124 and the right-side wall portion 122 of the body element 120 may have an arc-shape which is smaller than but close to 180 degrees (e.g., from 145 to 180 degrees). In some embodiments, a plurality of separation gaps are formed, and each separation gap is between any two adjacent portions of the left-half loop portion 111, the right-half loop portion 112, the front wall portion 121, the right-side wall portion 122, the back wall portion 123, and the left-side wall portion 124. Each separation is filled with a nonconductive material, such as a plastic material.

Figure 3:
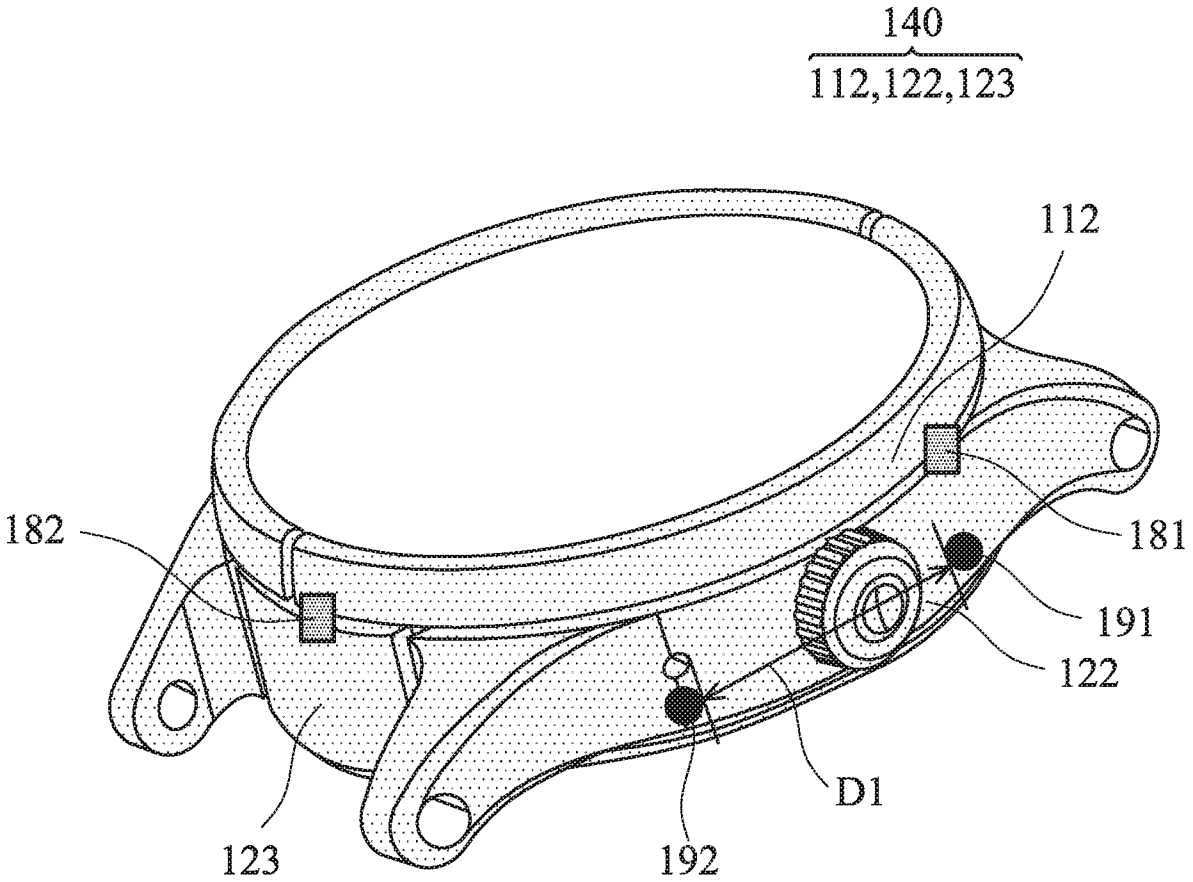
FIG. 3 is a perspective view of a first antenna structure of a wearable device according to an embodiment of the invention.

FIG. 3 is a perspective view of the first antenna structure 140 of the wearable device 100 according to an embodiment of the invention. In the embodiment of FIG. 3, the right-half loop portion 112 of the crown element 110 is respectively coupled to the right-side wall portion 122 and the back wall portion 123 of the body element 120, so as to form the first antenna structure 140. Specifically, the right-half loop portion 112 is coupled through a first connection point 181 to the right-side wall portion 122, and is further coupled through a second connection point 182 to the back wall portion 123. The right-side wall portion 122 is completely separated from the back wall portion 123 by a separation gap. The first connection point 181 may be a metal soldering point or a metal protrusion, which is positioned at the gap between the right-half loop portion 112 and the right-side wall portion 122. The second connection point 182 may be another metal soldering point or another metal protrusion, which is positioned at the gap between the right-half loop portion 112 and the back wall portion 123. The right-side wall portion 122 has a first feeding point 191 and a first grounding point 192. The first feeding point 191 may be coupled through a pogo pin or a metal spring to a first signal source on a PCB, and the first grounding point 192 may be coupled through another pogo pin or another metal spring to a ground plane on the PCB. In some embodiments, the front wall portion 121 or the back wall portion 123 is configured as an extension portion of the first antenna structure 140. To optimize the impedance matching of the first antenna structure 140, the first spacing D1 between the first feeding point 191 and the first grounding point 192 is from 10 mm to 20 mm, and preferably about 14.5 mm.

Figure 4:
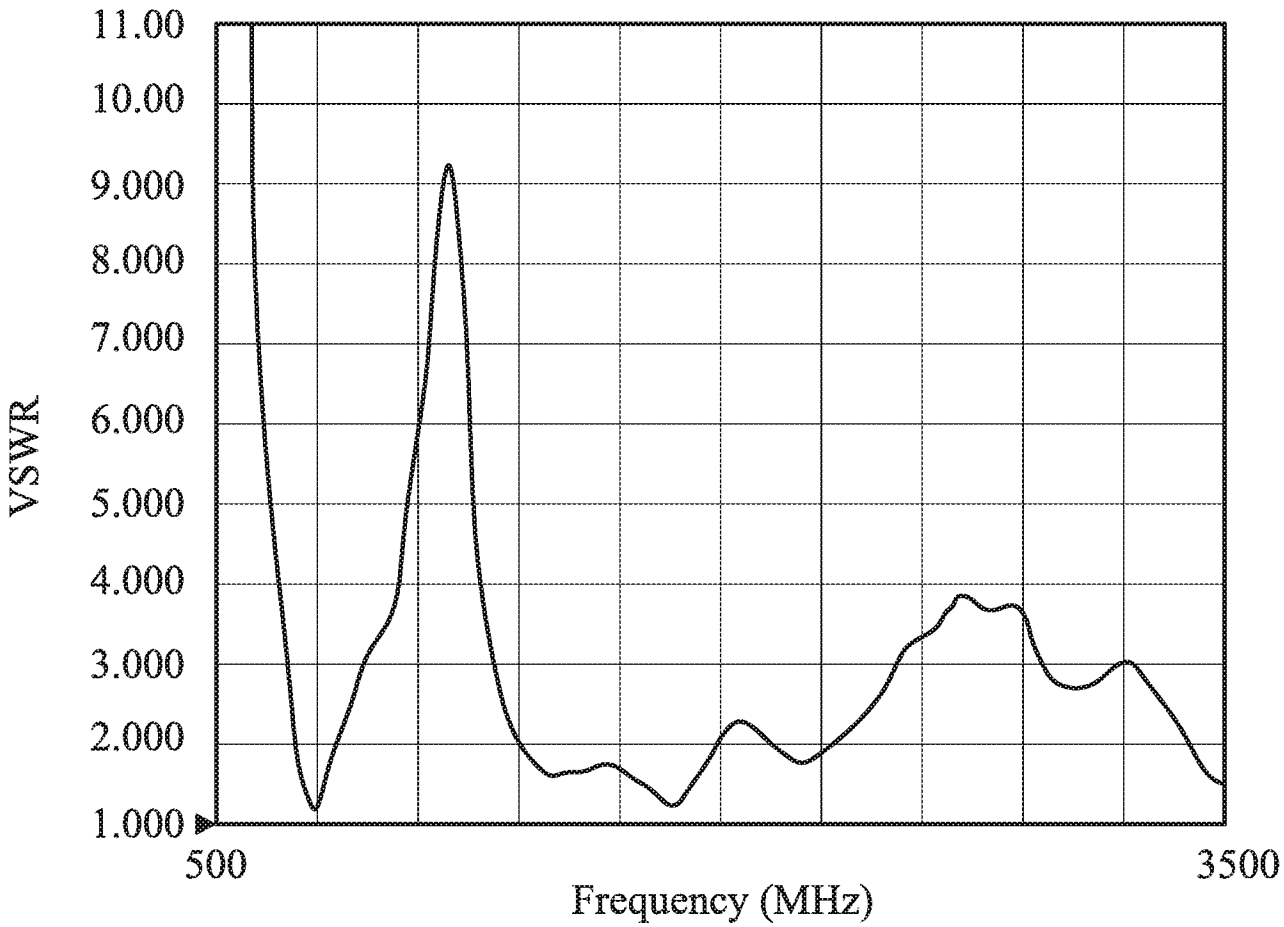
FIG. 4 is a VSWR (Voltage Standing Wave Ratio) of a first antenna structure of a wearable device according to an embodiment of the invention.

FIG. 4 is a VSWR (Voltage Standing Wave Ratio) of the first antenna structure 140 of the wearable device 100 according to an embodiment of the invention. The horizontal axis represents the operation frequency (MHz), and the vertical axis represents the VSWR. As shown in FIG. 4, the operation frequency band of the first antenna structure 140 may be from 699 MHz to 960 MHz and further from 1561 MHz to 2700 MHz. The first antenna structure 140 is considered as a 3D (Three-Dimensional) adjusted configuration of a PIFA (Planar Inverted F Antenna), it can support at least the wide multiple frequency bands of LTE (Long Term Evolution), GPS (Global Positioning System), WLAN (Wireless Local Area Network), and Bluetooth.

Figure 5:
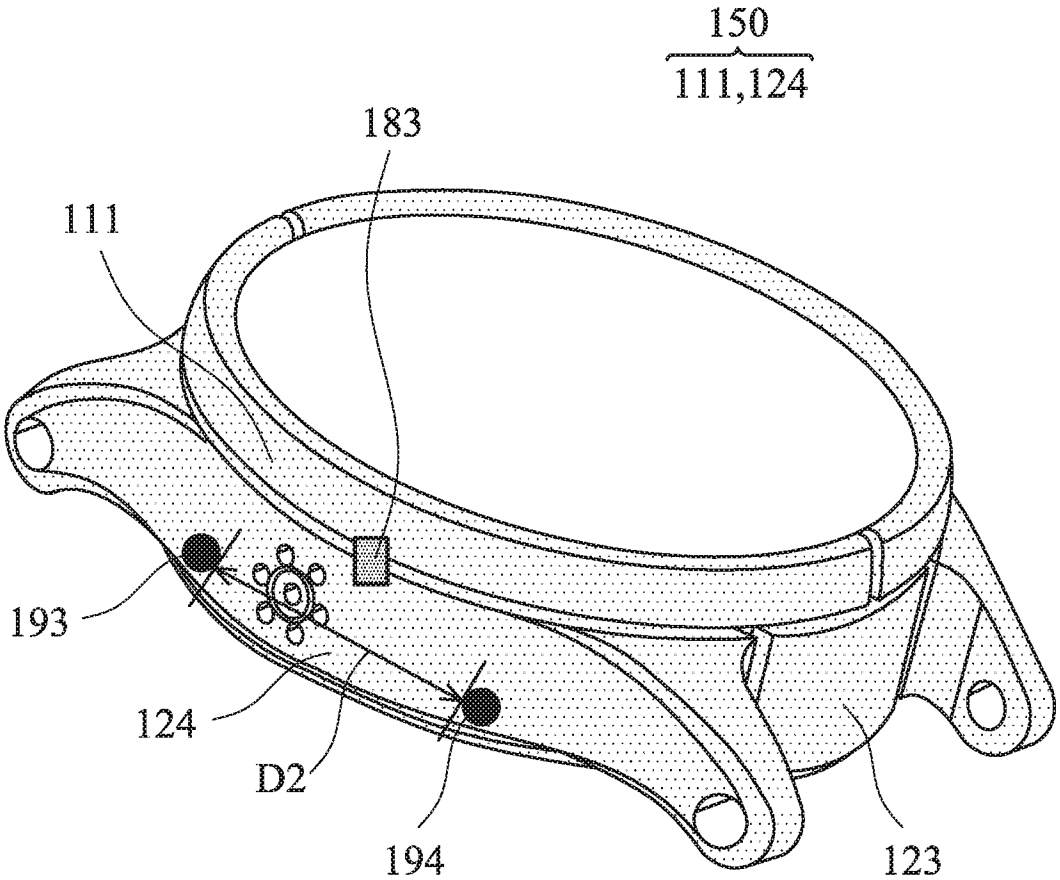
FIG. 5 is a perspective view of a second antenna structure of a wearable device according to an embodiment of the invention.

FIG. 5 is a perspective view of the second antenna structure 150 of the wearable device 100 according to an embodiment of the invention. In the embodiment of FIG. 5, the left-half loop portion 111 of the crown element 110 is coupled to the left-side wall portion 124 of the body element 120, so as to form the second antenna structure 150. Specifically, the left-half loop portion 111 is coupled through a third connection point 183 to the left-side wall portion 124. The third connection point 183 may be a metal soldering point or a metal protrusion, which is positioned at the gap between the left-half loop portion 111 and the left-side wall portion 124. The left-side wall portion 124 has a second feeding point 193 and a second grounding point 194. The second feeding point 193 may be coupled through a pogo pin or a metal spring to a second signal source on a PCB, and the second grounding point 194 may be coupled through another pogo pin or another metal spring to a ground plane on the PCB. In some embodiments, the front wall portion 121 or the back wall portion 123 is configured as an extension portion of the second antenna structure 150. To optimize the impedance matching of the second antenna structure 150, the second spacing D2 between the second feeding point 193 and the second grounding point 194 is from 10 mm to 20 mm, and preferably about 13 mm.

Figure 6:
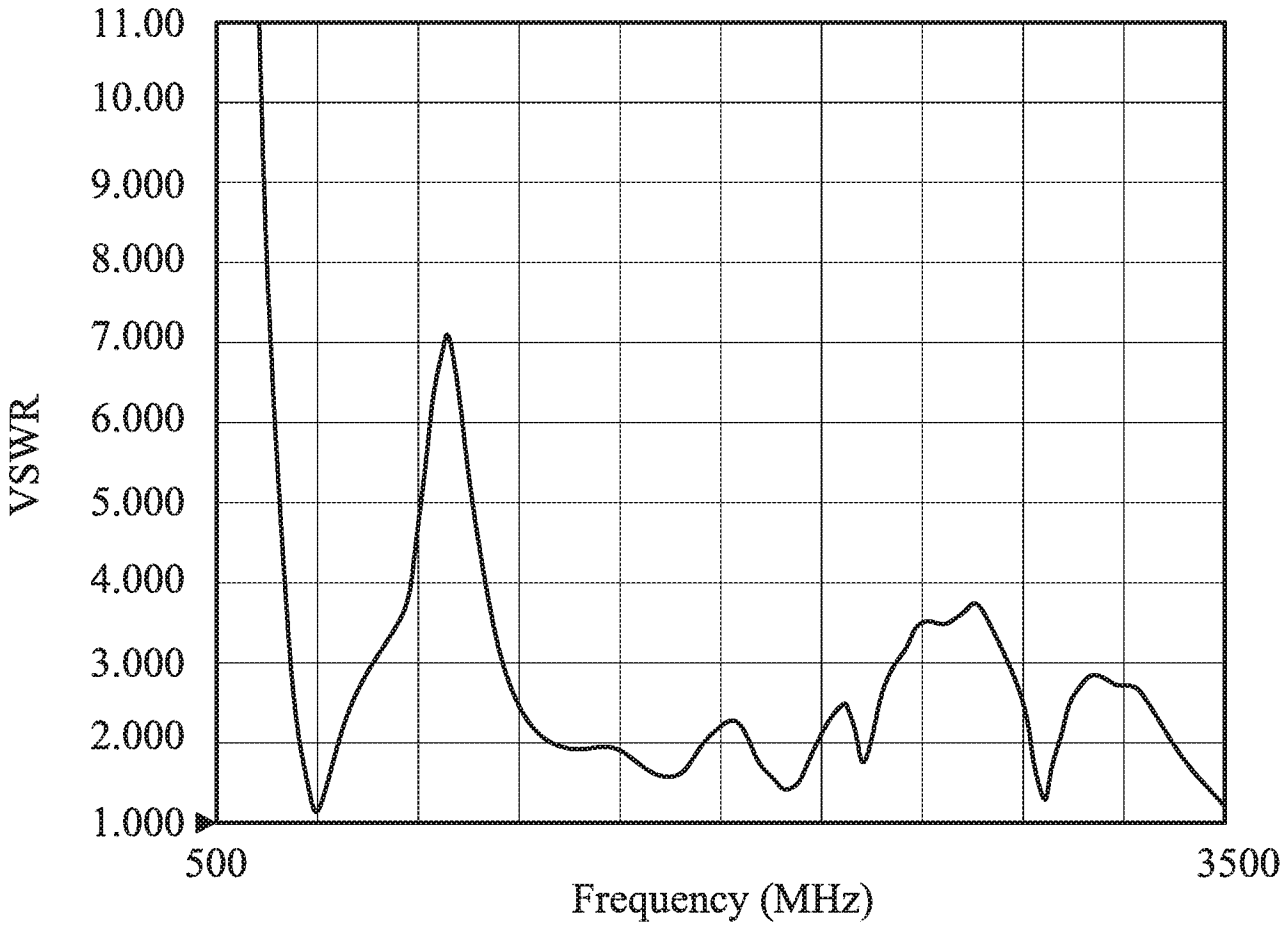
FIG. 6 is a VSWR of a second antenna structure of a wearable device according to an embodiment of the invention.

FIG. 6 is a VSWR of the second antenna structure 150 of the wearable device 100 according to an embodiment of the invention. The horizontal axis represents the operation frequency (MHz), and the vertical axis represents the VSWR. As shown in FIG. 6, the operation frequency band of the second antenna structure 150 may be from 699 MHz to 960 MHz and further from 1561 MHz to 2700 MHz. The second antenna structure 150 is considered as a 3D adjusted configuration of another PIFA, it can support at least the wide multiple frequency bands of LTE, GPS, WLAN, and Bluetooth.

The invention proposes a novel wearable device. In comparison to the conventional design, the invention has at least the following advantages: (1) using the appearance metal element of the wearable device to form antenna structures; (2) not additionally occupying the inner space of the wearable device; (3) providing both a main antenna and an auxiliary antenna to enhance the communication quality; (4) minimizing the total antenna size; and (5) reducing the total manufacturing cost. Therefore, the invention is suitable for application in a variety of small-size wearable devices with communication functions.

Note that the above element sizes, element shapes, and frequency ranges are not limitations of the invention. An antenna designer can adjust these settings or values according to different requirements. It should be understood that the wearable device and the antenna structure of the invention are not limited to the configurations of FIGS. 1-6. The invention may merely include any one or more features of any one or more embodiments of FIGS. 1-6. In other words, not all of the features shown in the figures should be implemented in the wearable device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. A wearable device, comprising:

a crown element;

a body element; and a bottom element;

wherein a hollow structure is formed by the crown element, the body element, and the bottom element;

wherein a first antenna structure and a second antenna structure are further formed by the crown element and the body element;

wherein a first separation gap is formed between the crown element and the body element, a second separation gap is formed between the body element and the bottom element, and both the first separation gap and the second separation gap are filled with nonconductive materials.

2. The wearable device as claimed in claim 1, wherein the wearable device is a watch, the crown element is a watch crown element, the body element is a watch body element, and the bottom element is a watch bottom element.

3. The wearable device as claimed in claim 1, wherein the crown element, the body element, and the bottom element are made of metal materials.

4. The wearable device as claimed in claim 1, further comprising:

a transparent element, wherein the transparent element is surrounded by the crown element.

5. The wearable device as claimed in claim 1, wherein the crown element comprises a left-half loop portion and a right-half loop portion, and wherein the body element comprises a front wall portion, a right-side wall portion, a back wall portion, and a left-side wall portion.

6. The wearable device as claimed in claim 5, wherein the right-half loop portion is coupled to the right-side wall portion so as to form the first antenna structure, and wherein the left-half loop portion is coupled to the left-side wall portion so as to form the second antenna structure.

7. The wearable device as claimed in claim 6, wherein the front wall portion or the back wall portion is configured as an extension portion of the first antenna structure or an extension portion of the second antenna structure.

8. The wearable device as claimed in claim 1, wherein the first antenna structure and the second antenna structure cover a same operation frequency band.

* * * * *